US010804004B2

(12) United States Patent
Konagaya et al.

(10) Patent No.: US 10,804,004 B2
(45) Date of Patent: Oct. 13, 2020

(54) CONDUCTING FILM AND METHOD FOR PRODUCING THE SAME

(71) Applicants: National University Corporation Nagoya University, Nagoya-shi, Aichi (JP); Fuji Polymer Industries Co., Ltd., Nagoya-shi, Aichi (JP)

(72) Inventors: Shigeji Konagaya, Aichi (JP); Toshio Saruyama, Aichi (JP); Hitoshi Shibuya, Aichi (JP)

(73) Assignees: NATIONAL UNIVERSITY CORPORATION NAGOYA UNIVERSITY, Aichi (JP); FUJI POLYMER INDUSTRIES CO., LTD., Aichi (JP)

( * ) Notice: Subject to any disclaimer, the term of this patent is extended or adjusted under 35 U.S.C. 154(b) by 30 days.

(21) Appl. No.: 15/207,039

(22) Filed: Jul. 11, 2016

(65) Prior Publication Data

US 2017/0018327 A1 Jan. 19, 2017

(30) Foreign Application Priority Data

Jul. 13, 2015 (JP) ..... 2015-139920

(51) Int. Cl.
*H01B 1/24* (2006.01)
*B05D 3/00* (2006.01)

(52) U.S. Cl.
CPC ..... *H01B 1/24* (2013.01); *B05D 3/007* (2013.01)

(58) Field of Classification Search
CPC ..... B05D 3/007; H01B 1/24
See application file for complete search history.

(56) References Cited

U.S. PATENT DOCUMENTS

2008/0302561 A1* 12/2008 Prud'Homme ..... B82Y 40/00 174/257
2009/0017211 A1* 1/2009 Gruner ..... C01B 32/194 427/258
2009/0226684 A1 9/2009 Bahnmuller et al.
2010/0065788 A1* 3/2010 Momose ..... C08G 18/673 252/511
2012/0256139 A1* 10/2012 Hunt ..... H01B 1/24 252/510
2012/0298971 A1 11/2012 Lee et al.
2013/0310521 A1 11/2013 Mukohata et al.
2013/0337320 A1 12/2013 Yukawa
2014/0076490 A1* 3/2014 Takada ..... H01B 1/24 156/249
2014/0087192 A1* 3/2014 Lai ..... H01G 11/30 428/409
2014/0295068 A1 10/2014 Nanba et al.
2015/0274924 A1* 10/2015 Pandey ..... C08J 9/0076 428/304.4
2016/0104892 A1 4/2016 Yukawa

FOREIGN PATENT DOCUMENTS

| | | | |
|---|---|---|---|
| CN | 101945959 | | 1/2011 |
| CN | 102391508 | A * | 3/2012 |
| CN | 103839608 | | 6/2014 |
| CN | 103839608 | A * | 6/2014 |
| JP | 2012-248842 | | 12/2012 |
| JP | 2013-035966 | | 2/2013 |
| JP | 2013035966 | A * | 2/2013 |
| JP | 2013-079348 | | 5/2013 |
| JP | 2013079348 | A * | 5/2013 |
| JP | 2013-152928 | | 8/2013 |
| JP | 2013-155461 | | 8/2013 |
| JP | 2013-213177 | | 10/2013 |
| JP | 2014-199793 | | 10/2014 |
| JP | 2014-209472 | | 11/2014 |
| KR | 20130048581 | A * | 5/2013 |

OTHER PUBLICATIONS

KR-20130048581-A translation.*
JP-2013079348-A translation.*
JP-2013035966-A Machine Translation (Year: 2013).*
Zhang, et al., "Sulfonated graphene oxide: the new and effective material for synthesis of polystyrene-based nanocomposites", Colloid Polymer Science, vol. 291, 2013, pp. 2061-2068.
Nicotera, et al., "Sulfonated Graphene Oxide Platelets in Nafion Nanocomposite Membrane: Advantages for Application in Direct Methanol Fuel Cells", The Journal of Physical Chemistry, vol. 118, 2014, pp. 24357-24368.
Office Action issued in corresponding Chinese Patent Application No. 201610490872.X, dated Feb. 19, 2019, 17 pages.
Office Action issued in corresponding Chinese Patent Application No. 201610490872.X, dated May 13, 2020, 7 pages with a partial translation.
Decision of Refusal issued in corresponding Japanese Patent Application No. 2016-126689, dated Jun. 25, 2020, 4 pages with translation.

* cited by examiner

*Primary Examiner* — Travis M Figg
(74) *Attorney, Agent, or Firm* — Hamre, Schumann, Mueller & Larson, P.C.

(57) ABSTRACT

A conducting film of the present invention includes (A) graphene and/or graphene oxide, and/or derivatives thereof, and (B) a compound having a sulfonic acid group, and/or derivatives thereof, and has a volume resistivity of $1\times10^4$ Ω·cm or less. A method for producing the conducting film of the present invention includes preparing a dispersion by dispersing a component including (A) graphene and/or graphene oxide, and/or derivatives thereof, and (B) a compound having a sulfonic acid group, and/or derivatives thereof in a dispersion medium, applying the dispersion on a substrate and drying it, and performing heat treatment at a temperature of 100° C. or more. Thereby, the present invention provides a conducting film that has high conductivity and can be applied to a wide range of composites including graphenes, and a method for producing the same.

11 Claims, No Drawings

CONDUCTING FILM AND METHOD FOR PRODUCING THE SAME

BACKGROUND OF THE INVENTION

1. Field of the Invention

The present invention relates to a conducting film having high conductivity, and a method for producing the same. Specifically, the present invention relates to a conducting film that can be used in the form of, e.g., a coating material, a layered body, and a film, and a method for producing the same.

2. Description of Related Art

Carbon materials including carbon fibers, graphite, and carbon nanotubes have been attracting attention because they have high elastic modulus, high conductivity and high thermal conductivity. A carbon material having a graphene structure is also included in such carbon materials. The carbon material having a graphene structure (hereinafter referred to as "graphenes") includes, for example, single layer graphene and a material having two or more layers of a graphene structure. A graphene oxide as a material having two or more layers of the graphene structure can be relatively easily manufactured from graphite, and the mass production thereof for use in a composite material, which satisfies economic efficiency, has been expected.

Non-Patent Document 1 discloses that the surface of graphene oxide (GO) was sulfonated using sulfamic acid ($NH_2SO_3H$) to obtain sulfonated graphene oxide (S-GO), which was then mixed with a polystyrene emulsion, so that a nano conposite was formed. The sulfonation allows dispersing a styrene monomer (lipophilic) in water to enable emulsion polymerization, and filling the graphene oxide in the polystyrene emulsion with high dispersibility. The structure and role of the sulfonated graphene oxide are evidenced by IR, XPS, AFM, an optical microscope, SEM, TEM, or the like. Non-Patent Document 1 proposes that sulfonation of the graphene oxide made it possible to synthesize the polystyrene and the graphene oxide into a high dispersing nanocomposite, however, conductivity and thermal conductivity are not mentioned. Furthermore, preparation of the nanocomposite (emulsion polymerization) was performed at a temperature of 70° C., and drying was performed at a temperature of 50° C., while Non-Patent Document 1 does not mention that heating allows graphene oxide to be reduced, thereby greatly improving the conductivity and the thermal convuctivity. Non-Patent Document 2 discloses that a fluorine-based polymer film, which is useful as a fuel cell film material, was filled with sulfonated graphene oxide to enhance heat resistance and diffusion rate of water under a high temperature of 100° C. or more for the sake of improving the performance of the fuel cell film under a high temperature. In Non-Patent Document 2, the sulfonation of graphene oxide was performed by causing graphene oxide to react with 3-amino-1-propanesulfonic acid. In particular, the composite was obtained by mixing and dispersing the graphene oxide in a Nafion solution, applying the resultant mixture on a substrate, and then drying at 40° C. There is no mention about reduction of the graphene oxide by heating. For the obtained composite film, the diffusion coefficients of water, methanol, acetic acid, and the like were measured at temperatures in a range from a room temperature to about 130° C., however, this temperature range was set merely for the purpose of characteristics measurement, and the reduction of graphene oxide or improvement of conductivity and thermal conductivity were not considered. As described above, in Non-Patent Documents 1 and 2, it is considered that since the sulfonated graphene oxide, which generally has lower conductivity than graphene oxide, was used and moreover, the sulfonated graphene oxide was not heated at a temperature of 100° C. or more from a dried state, the conductivity was not improved to the extent that the conductivity reached $1\times10^4$ Ω·cm or less. As another proposal, a method for manufacturing electrodes for an accumulator battery that uses graphenes as a conductive assistant, and the accumulator battery are disclosed (Patent Documents 1 and 2). Research and development of a composite material including a polymer have also been advanced. It is proposed that high elastic modules of a polyvinyl alcohol-based fiber can be achieved by including graphene oxide (Patent Document 3). Patent Document 4 proposes the improvement of a balance between mechanical strength and impact resistance by adding graphene oxide to a resin having a carboxyl group, a carboxylic acid anhydride group, a sulfonic acid group, an amino group, an amide group, an epoxy group, a halogen group, a nitrile group, an isocyanate group, or the like. Patent Document 5 proposes a compound having high mechanical strength composed of a thermoplastic resin, graphenes, and a reactive multi-functional compound including a carboxyl group, a carbonyl group, a sulfonic acid group, a hydroxyl group, an isocyanate group, a silyl group, a siloxy group, an alkoxy group, a vinyl group, chlorine, an aryl group, an amino group, an ether group, an ester group, an amide group, a thiol group, a (meth) acrylic group, an epoxy group, or the like. These proposals indicate that various functional groups enhance the reactivity between the graphenes and the polymer, thereby improving the mechanical strength.

However, none of these proposals suggest the conductivity and thermal conductivity of the polymer composition including the graphenes. Some of the present inventors conducted numerous studies on how to utilize conductivity and thermal conductivity of the graphenes, and proposed that a composition formed of poly (3,4-ethylene dioxy) thiophene, polystyrene sulfonic acid, and graphenes has high conductivity and is useful as a conductive coating material (Patent Document 6).

PRIOR ART DOCUMENTS

Patent Documents

Patent Document 1: JP 2014-199793 A
Patent Document 2: JP 2014-209472 A
Patent Document 3: JP 2013-155461 A
Patent Document 4: JP 2013-079348 A
Patent Document 5: JP 2013-213177 A
Patent Document 6: JP 2013-035966 A

Non-Patent Documents

Non-Patent Document 1: Colloid Polymer Science, (2013), 291: pp. 2061-2068
Non-Patent Document 2: The Journal of Physical Chemistry C 2014, 118, pp. 24357-24368

However, the conductivity is still insufficient in the above conventional technologies.

The present invention provides a conducting film that has high conductivity and can be applied to a wide range of composites including graphenes, and a method for producing the same.

SUMMARY OF THE INVENTION

Therefore, with the foregoing in mind, it is an object of the present invention to provide a conducting film that includes (A) graphene and/or graphene oxide, and/or derivatives thereof, and (B) a compound having a sulfonic acid group, and/or derivatives thereof, and has a volume resistivity of $1\times10^4$ Ω·cm or less.

A method for producing the conducting film of the present invention includes preparing a dispersion by dispersing a component including (A) graphene and/or graphene oxide, and/or derivatives thereof, and (B) a compound having a sulfonic acid group, and/or derivatives thereof in a dispersion medium, applying the dispersion on a substrate and drying it, and performing heat treatment at a temperature of 100° C. or more, thereby obtaining the conducting film having a volume resistivity of $1\times10^4$ Ω·cm or less.

The conducting film of the present invention can improve the conductivity of the component (A) by heating in the presence of the components (A) and (B). That is, the component (A) inherently has high conductivity due to a conjugated double bond, and in addition, in the conducting film of the present invention, it is considered that the conductivity is further improved by heat treatment at a temperature of 100° C. or more in the presence of the component (B) that causes a decrease in a C—O bond and an increase in a $sp^2$ bond (C═O bond) and the conjugated double bond, which enables a smooth flow of pi electrons in the graphene. The conducting film of the present invention can be utilized by including only the above-described two components, and moreover, can be imparted with physical properties and adhesive properties suitable for the intended use by addition of other components. For example, the strength of a coating film or a film can be improved by adding a film-forming polymer.

DETAILED DESCRIPTION OF THE INVENTION

In the present invention, graphene and/or graphene oxide, and/or derivatives thereof is used as a component (A). The graphene is a thin-layer graphite, including a single-layer graphite and a graphite having two or more layers. The graphene oxide is generally produced by oxidizing graphite, including a single-layer graphite oxide and a graphite oxide having two or more layers. The size of the graphene and the graphene oxide can be measured by a light scattering method. The graphene or the graphene oxide used in the present invention may have any particle size distribution. However, the graphene or the graphene oxide having an average particle diameter of 2 μm or more is preferred to achieve high conductivity and film formability. For various uses that effectively utilize high conductivity and thermal conductivity, a complex material including various materials in addition to the components (A) and (B) is generally used. In that case, the dispersibility of the component (A) is important, and the graphene oxide is preferable in this regard.

The compound having a sulfonic acid group used as the component (B) of the present invention is a compound including a sulfonic acid group in its molecular structure, and no particular limitation is imposed thereon. For example, inorganic sulphonic acids such as sulfuric acid, fluorosulfonic acid, and chlorosulfonic acid, aliphatic sulfonic acids such as methanesulfonic acid, ethanesulfonic acid, propane sulfonic acid, hexanesulfonic acid, and dodecanesulfonic acid, substituted aliphatic sulfonic acids such as trifluoromethanesulfonic acid, aminomethanesulfonic acid, and 3-aminopropane sulfonic acid, aromatic sulfonic acids such as methoxyanilinesulfonic acid, ethoxyanilinesulfonic acid, 2-amino-5-methylbenzene-1-sulfonic acid, benzenesulfonic acid, dodecylbenzenesulfonic acid, p-chlorobenzensulfonic acid, p-phenolsulfonic acid, benzenesulfonic acid, p-chlorobenzensulfonic acid, p-styrenesulfonic acid, toluenesulfonic acid, and naphthalenesulfonic acid, sulfonic acid group bonded phthalate esters, vinylsulfonic acids, sulfonic acid type cation exchange resins, or the like may be used. Further, multifunctional sulfonic acids such as 1,5-naphtalenedisulfonic acid may also be used.

The compound having a sulfonic acid group of the component (B) is preferably an aromatic sulfonic acid, and particularly preferably an organic compound including a sulfonic acid group bonded to a benzene ring, because they are useful for improving the conductivity. Specifically, methoxyanilinesulfonic acid, ethoxyanilinesulfonic acid, 2-amino-5-methylbenzene-1-sulfonic acid, benzenesulfonic acid, dodecylbenzenesulfonic acid, p-chlorobenzensulfonic acid, p-phenolsulfonic acid, benzenesulfonic acid, p-chlorobenzensulfonic acid, p-styrenesulfonic acid, toluenesulfonic acid, naphthalenesulfonic acid, 1,5-naphthalenedisulfonic acid, or the like is preferable.

Polymers having a sulfonic acid group can also be used as the component (B). For example, a homo-polymer of a compound having a sulfonic acid group such as isoprenesulfonic acid, vinylsulfonic acid, allylsulfonic acid, or a copolymer with styrene, methyl methacrylate, methyl acrylate, vinyl acetate, acrylamide, butadiene, or the like can also be used. Sulfonic acid group bonded vinyl chloride, sulfonic acid group bonded polyester, polystyrene sulfonic acid, a sulfonated polystyrene, or the like can also be used effectively.

Sulfonic acid derivatives such as salts of the above-described sulfonic acid compounds can also be used as the component (B). Further, polyaniline sulfonic acid, polyaminoanisole sulfonic acid, or the like having a sulfonic acid group can also be used.

In the conducting film of the present invention, it is often preferable to increase the ratio of the component (A), because it is advantageous for achieving high conductivity and thermal conductivity. For this reason, the component (B) may be at least one material selected from a monomer, an oligomer, and a polymer having a sulfonic acid group, and/or derivatives thereof. As an example, the component (B) may be a low molecular weight substance having a molecular weight of 800 or less.

Although no particular limitation is imposed on the composition ratio of the components (A) and (B), the content of the component (B) is preferably 3 parts by mass or more and 200 parts by mass or less, and particularly preferably 5 parts by mass or more and 100 parts by mass or less with respect to 100 parts by mass of the component (A). When the content of the component (B) is less than 3 parts by mass, the effect of improving conductivity and thermal conductivity is hardly exhibited, and when the content of the component (B) is more than 200 parts by mass, mechanical properties as a conducting material and a thermal conducting material are impaired, resulting in difficulty in obtaining the effect of the conducting film of the present invention.

In the present invention, it is preferred to perform heat treatment at a temperature of more than 100° C. and 250° C. or less to obtain excellent conductivity and thermal conductivity. The heat treatment temperature of 100° C. or less should be avoided because it may cause a failure to obtain excellent conductivity and thermal conductivity, or may require an extremely long heat treatment time. The heat treatment temperature of more than 250° C. should be avoided because it may cause thermal decomposition of the conducting film. The heat treatment temperature in a range from 130° C. to 200° C. is more preferable. Although no particular limitation is imposed on the heat treatment time, the heat treatment time is preferably in a range from 10 minutes to 6 hours, and more preferably in a range from 30 minutes to 5 hours.

The conducting film of the present invention has a volume resistivity of $1\times10^{4}$ Ω·cm or less, preferably $1\times10^{-5}$ Ω·cm or more and $1\times10^{4}$ Ω·cm or less, more preferably $1\times10^{-5}$ Ω·cm or more and $5\times10^{3}$ Ω·cm or less, and further preferably $1\times10^{-4}$ Ω·cm or more and $1\times10^{3}$ Ω·cm or less. The volume resistivity in the above ranges can achieve high conductivity. The volume resistivity can be lowered (increase the conductivity) by adjusting the oxidation degree of the graphene oxide.

The conducting film has a thickness preferably in a range from 0.001 mm to 1.0 mm, more preferably in a range from 0.003 mm to 0.5 mm, and further preferably in a range from 0.004 mm to 0.1 mm. The conducting film having a thickness in the above ranges may be in a state of being stuck on a substrate, or may be peeled off and separated from the substrate for use. It is possible to form a thicker film by overcoating, i.e., by repeating the coating and drying.

Although no particular limitation is imposed on the method for producing the conducting film of the present invention, a method generally used is preparing a dispersion by dispersing the components (A) and (B) using water and/or an appropriate organic solvent, and applying the dispersion to an appropriate substrate and drying it.

Water or a water-soluble organic solvent is preferable because they often have high affinity for both of the components (A) and (B). Examples of the water-soluble organic solvent include water-soluble alcohols such as methanol, ethanol, isopropyl alcohol, butanol, and 2-methoxyethanol, water-soluble ketones such as acetone, water-soluble oxygen-containing cyclic derivatives such as tetrahydrofuran, and non-protonic polar solvents such as dimethylformamide and dimethyl sulfoxide. Other organic solvents may be used if they have high affinity for the components (A) and (B). Examples of the other organic solvent include aromatic solvents such as toluene, xylene, and ethylbenzene, halogen-containing solvents such as chloroform and dichloromethane, ester-based solvents such as ethyl acetate and butyl acetate, ketones such as methyl ethyl ketone and methyl isobutyl ketone, pentanol, and benzyl alcohol.

The heat treatment for producing the conducting film of the present invention is generally performed after applying and drying the dispersion. The heat treatment condition is as described above.

In the conducting film of the present invention, a polymer may be used as a component (C). The use of the component (C) enables the composition to improve film formability, mechanical strength of the film, and adhesion to a substrate. Examples of the matrix polymer of the component (C) include polyolefin such as polyethylene and polypropylene, chlorinated polyolefin, fluorinated polyolefin, polystyrene, polyester, polyamide, polyacetal, polycarbonate, polyethylene glycol, polyethylene oxide, polyacrylic acid, polyacrylic acid ester, polymethacrylic acid ester, and polyvinyl alcohol. Moreover, an epoxy resin, a urethane resin, an acrylic resin, a silicone resin, and precursors thereof, which are to be cured by heat or ultraviolet irradiation after the composition used in the present invention is applied and dried, may be used. These matrix polymers which finally become resinous or elastomeric polymers may be used.

Although no limitation is imposed on the use of the matrix polymer according to its characteristics, it is preferable in terms of workability to use a polymer having high affinity for water. Examples of the matrix polymer include polyvinyl alcohol, water-dispersible polyester, and water-dispersible acrylic polymer. When the components (A) and (B) have high affinity for the organic solvent, polymers or derivatives thereof other than the above-described polymers can be used. No limitation is imposed on the amount of the component (C) used as long as the effects of the present invention are maintained. In other words, the amount of the component (C) used is determined according to the intended use of the conducting film of the present invention.

The conducting film of the present invention may include, e.g., other conductivity-imparting agents, conductive polymers, heat conductive fillers, other fillers, flame retardants, heat-resistant agents, antioxidants, ultraviolet absorbers, surfactants, and coupling agents according to the intended use or the like, as long as they do not impair the performance of the conducting film of the present invention.

The composition used in the present invention may be applied on a substrate and dried, and subjected to heat treatment etc., so as to be used as a coating material. Although no particular limitation is imposed on the substrate, it is preferable to use, for example, glass, ceramics such as alumina, metals such as copper and aluminum, plastic films such as polyethylene terephthalate and an acrylic resin.

The composition may be applied on an appropriate substrate and dried, and subjected to heat treatment, and then peeled off and separated from the substrate so as to be used in a form of a film or a sheet.

The conducting film of the present invention includes (A) graphene and/or graphene oxide, and/or derivatives thereof, and (B) a compound having a sulfonic acid group, and/or derivatives thereof. The conducting film of the present invention is subjected to heat treatment at a temperature of more than 100° C. and 250° C. or less. From the analysis of an X-ray photoelectron spectroscopy (XPS), it is considered that heat treatment in the presence of the component (B) causes a decrease in a C—O bond and an increase in a $sp^2$ bond (C═O bond) and a conjugated double bond of the component (A), which enables a smooth flow of pi electrons in the graphene, thereby improving the conductivity. The readily movable conjugated pi electrons in the conducting film are known to be effective for transmitting heat. Therefore, the film can be utilized as a material including only the two components, and moreover, can be imparted with physical properties and adhesive properties suitable for a variety of uses by addition of other components. For example, the strength of a coating film or a film can be improved by adding a film-forming polymer. Further, film formability and mechanical strength can be improved by using the matrix polymer as needed. Therefore, it can be utilized for a variety of uses that require conductivity and thermal conductivity.

EXAMPLES

Next, the present invention is further specifically described by way of examples and comparative examples. It should be noted that the present invention is not limited to these examples. The average particle diameter was measured by a light scattering method using Zeta-potential& Particle size Analyzer "ELS-Z" (product name) manufactured by Otsuka Electronics Co., Ltd.

Example 1

10 g of a water-soluble graphene oxide dispersion "GO-10" (trade name) manufactured by NiSiNa materials Co. Ltd. (solid content 1.0 mass %, average particle diameter 13 μm), 10 g of dodecylbenzenesulfonic acid (DBSA) diluted to have a concentration of 1.0 mass % (mass ratio of graphene oxide:DBSA=100:100) were added in a test tube, and glass beads were added and mixed with an ultrasonic dispersion apparatus for 30 minutes. 500 μl of the dispersion was dropped on and applied to a glass plate and dried, and subjected to heat treatment at a temperature of 100° C. for 1 hour, so that a conducting film was formed. A surface resistance value was measured, and a volume resistance value was calculated from the surface resistance value. In the calculation of the volume resistance value, the thickness of a sample was calculated from an arithmetic average density, which was calculated based on the densities and the composition ratio of the graphene oxide and DBSA, and the mass of solid content in 500 μl of the dispersion dropped on the glass plate. The thickness of the conducting film was 6 μm. The heat treatment does not affect the thickness of the film.

The sample after measurement of the surface resistance value was subsequently subjected to heat treatment at 130° C. for 1 hour, and the volume resistance value was obtained in the above-described manner. Using the same sample, heat treatment was sequentially performed at temperatures of 150° C., 170° C., and 200° C., and the volume resistance value was obtained in the above-described manner.

The results are shown in Table 1. The composition (mass ratio) in the table represents a solid content mass ratio of the graphene oxide and DBSA, while the mass of the graphene oxide was set to 100.

Examples 2-5

10 g of a water-soluble graphene oxide dispersion "GO-10" (trade name) manufactured by NiSiNa materials Co. Ltd. (solid content 1.0 mass %, average particle diameter 13 μm), and each of 5.0 g, 2.5 g, 1.25 g, and 0.625 g of dodecylbenzenesulfonic acid (DBSA) diluted to have a concentration of 1.0 mass % (mass ratio of graphene oxide: DBSAfor each amount of DBSA=100:50, 100:25, 100:12.5, and 100:6.25) were added in the respective four test tubes, and glass beads were added and mixed with an ultrasonic dispersion apparatus for 30 minutes. Then, heat treatment was sequentially performed at temperatures of 100° C., 130° C., 150° C., 170° C., and 200° C. in the same way as in Example 1, and the surface resistance value was accordingly measured after each heat treatment. The measured data is summarized in Table 1. The thickness of the conducting films after heat treatment were as follows: Example 2 was 6 μm, Example 3 was 6 μm, Example 4 was 5 μm, and Example 5 was 5 μm.

Comparative Example 1

A film was produced in the same way as in Example 1 except that the water-soluble graphene oxide dispersion alone was used without adding DBSA, and dried at 100° C. for 1 hour. The resultant film had a volume resistivity of $5.3\times10^3$ Ω·cm, and a thickness of 5 μm.

TABLE 1

| | Composition (mass ratio) | | Heat treatment condition | | | | |
|---|---|---|---|---|---|---|---|
| | | | 100° C. × 1 hr | Left condition + 130° C. × 1 hr | Left condition + 150° C. × 1 hr | Left condition + 170° C. × 1 hr | Left condition + 200° C. × 1 hr |
| | Graphene oxide | DBSA | volume resistivity (Ω · cm) | volume resistivity (Ω · cm) | volume resistivity (Ω · cm) | volume resistivity (Ω · cm) | volume resistivity (Ω · cm) |
| Ex. 1 | 100 | 100 | $3.2 \times 10^3$ | $2.1 \times 10^{-1}$ | $1.5 \times 10^{-1}$ | $7.9 \times 10^{-2}$ | $7.7 \times 10^{-2}$ |
| Ex. 2 | 100 | 50 | $2.4 \times 10^2$ | $9.3 \times 10^{-2}$ | $5.4 \times 10^{-2}$ | $4.0 \times 10^{-1}$ | $3.6 \times 10^{-2}$ |
| Ex. 3 | 100 | 20 | $6.4 \times 10^3$ | $1.1 \times 10^1$ | $1.1 \times 10^{-1}$ | $4.7 \times 10^{-2}$ | $3.1 \times 10^{-2}$ |
| Ex. 4 | 100 | 10 | $3.4 \times 10^3$ | $6.0 \times 10^{-1}$ | $6.5 \times 10^{-2}$ | $3.5 \times 10^{-2}$ | $2.7 \times 10^{-2}$ |
| Ex. 5 | 100 | 5 | $5.6 \times 10^3$ | $1.5 \times 10^2$ | $4.3 \times 10^{-1}$ | $6.4 \times 10^{-2}$ | $3.6 \times 10^{-2}$ |

As shown in Table 1, in the films in which the dodecylbenzenesulfonic acid (DBSA) is present, the decrease in the volume resistivity by heat treatment at temperatures of 130° C. to 200° C. was more than 10000 times as much as the decrease in the volume resistivity by heat treatment at a temperature of 100° C., thereby achieving the volume resistance value of 0.1 Ω·cm or less. The results confirmed that the presence of DBSA greatly improved the conductivity of the graphene oxide film.

Examples 6-10

Five different types of films were prepared in the same way as in Examples 1 to 5 except that methoxyanilinesulfonic acid (MASA) was used instead of the dodecylbenzenesulfonic acid, and the volume resistance value was measured. The manufacturing condition and the volume resistance value of the conducting films are shown in Table 2. The thickness of the conducting films after heat treatment were as follows: Example 6 was 5 μm, Example 7 was 5 μm, Example 8 was 5 μm, Example 9 was 5 μm, and Example 10 was 5 μm.

TABLE 2

| | Composition (mass ratio) | | Heat treatment condition | | | | |
|---|---|---|---|---|---|---|---|
| | | | 100° C. × 1 hr volume | Left condition + 130° C. × 1 hr volume | Left condition + 150° C. × 1 hr volume | Left condition + 170° C. × 1 hr volume | Left condition + 200° C. × 1 hr volume |
| | Graphene oxide | MASA | resistivity (Ω · cm) | resistivity (Ω · cm) | resistivity (Ω · cm) | resistivity (Ω · cm) | resistivity (Ω · cm) |
| Ex. 6 | 100 | 100 | $3.5 \times 10^{4}$ | $5.2 \times 10^{-1}$ | $3.7 \times 10^{-2}$ | $2.8 \times 10^{-2}$ | $2.7 \times 10^{-2}$ |
| Ex. 7 | 100 | 50 | $8.3 \times 10^{3}$ | $4.5 \times 10^{-2}$ | $3.3 \times 10^{-2}$ | $2.0 \times 10^{-2}$ | $1.9 \times 10^{-2}$ |
| Ex. 8 | 100 | 20 | $6.0 \times 10^{3}$ | $7.8 \times 10^{-2}$ | $3.4 \times 10^{-2}$ | $2.2 \times 10^{-2}$ | $1.9 \times 10^{-2}$ |
| Ex. 9 | 100 | 10 | $3.3 \times 10^{3}$ | $8.0 \times 10^{-1}$ | $8.1 \times 10^{-2}$ | $3.5 \times 10^{-2}$ | $2.7 \times 10^{-2}$ |
| Ex. 10 | 100 | 5 | $5.8 \times 10^{3}$ | $3.4 \times 10^{1}$ | $5.7 \times 10^{-1}$ | $6.1 \times 10^{-2}$ | $3.9 \times 10^{-2}$ |

As shown in Table 2, in the films in which the methoxyanilinesulfonic acid (MASA) is present, the decrease in the volume resistivity by heat treatment at temperatures of 130° C. to 200° C. was more than 10000 times as much as the decrease in the volume resistivity by heat treatment at a temperature of 100° C., thereby achieving the volume resistance value of 0.1 Ω·cm or less. The results confirmed that the presence of MASA greatly improved the conductivity of the graphene oxide film.

Examples 11-15

Five different types of films were prepared in the same way as in Examples 1 to 5 except that polystyrene sulfonic acid (PSS) was used instead of the dodecylbenzenesulfonic acid, and the volume resistance value was measured. The manufacturing condition and volume resistance value of the conducting films are shown in Table 3. The thickness of the conducting films were as follows: Example 11 was 7 μm, Example 12 was 6 μm, Example 13 was 6 μm, Example 14 was 6 μm, and Example 15 was 6 μm.

TABLE 3

| | Composition (mass ratio) | | Heat treatment condition | | | | |
|---|---|---|---|---|---|---|---|
| | | | 100° C. × 1 hr volume | Left condition + 130° C. × 1 hr volume | Left condition + 150° C. × 1 hr volume | Left condition + 170° C. × 1 hr volume | Left condition + 200° C. × 1 hr volume |
| | Graphene oxide | PSS | resistivity (Ω · cm) | resistivity (Ω · cm) | resistivity (Ω · cm) | resistivity (Ω · cm) | resistivity (Ω · cm) |
| Ex. 11 | 100 | 100 | $9.1 \times 10^{1}$ | $1.1 \times 10^{1}$ | $4.4 \times 10^{-1}$ | $2.0 \times 10^{-1}$ | $1.2 \times 10^{-1}$ |
| Ex. 12 | 100 | 50 | $2.3 \times 10^{2}$ | $3.4 \times 10^{1}$ | $4.1 \times 10^{-1}$ | $2.1 \times 10^{-1}$ | $9.1 \times 10^{-2}$ |
| Ex. 13 | 100 | 20 | $6.5 \times 10^{2}$ | $7.2 \times 10^{2}$ | $6.6 \times 10^{0}$ | $2.8 \times 10^{-1}$ | $15 \times 10^{-1}$ |
| Ex. 14 | 100 | 10 | $7.7 \times 10^{2}$ | $7.0 \times 10^{2}$ | $4.5 \times 10^{1}$ | $4.1 \times 10^{-1}$ | $8.5 \times 10^{-2}$ |
| Ex. 15 | 100 | 5 | $7.7 \times 10^{2}$ | $1.8 \times 10^{3}$ | $3.0 \times 10^{1}$ | $2.3 \times 10^{-1}$ | $8.6 \times 10^{-2}$ |

As shown in Table 3, although the films in which the polystyrene sulfonic acid (PSS) as a polymer is present showed a small decrease in the volume resistance value as compared with the films of the low molecular weight sulfonic acid (Examples 1-10), a decrease in the volume resistivity of the films in which the polystyrene sulfonic acid (PSS) is present was 3 to 10 times as much as that of the films of the graphene oxide alone by heat treatment at temperatures of 150° C. to 170° C. The results confirmed that the presence of PSS greatly improved the conductivity of the graphene oxide film.

Example 16

A water-soluble graphene oxide dispersion "SP-1" (trade name) manufactured by NiSiNa materials Co. Ltd. (solid content 1.0 mass %, average particle diameter 10 μm), and the dodecylbenzenesulfonic acid (DBSA) were mixed to prepare a mixed dispersion having a solid ratio of graphene oxide:DBSA of 5:1. About 1 g of "Vylonal MD-1200" (manufactured by TOYOBO CO., LTD., (diluted to have a solid content of 3 mass %)) was injected in a test tube, and the mixed dispersion were added to have a ratio of graphene oxide:DBSA: MD-1200 of 42:8.4:50, and glass beads were added and dispersed with ultrasonic waves for 30 minutes. 500 μl of the dispersion was dropped on a glass plate and dried, and subjected to heat treatment at a temperature of 100° C. for 1 hour, and continuously subjected to heat treatment at a temperature of 130° C. for 1 hour, so that a conducting film including a polymer was formed. A surface resistance value was measured, and a volume resistance value was calculated in the same way as in Example 1. The sample after measurement of the surface resistance was subsequently subjected to heat treatment at 150° C. for 1 hour, and a volume resistance value was obtained in the above-described manner. Using the same sample, heat treatment was performed at 170° C. for 1 hour and the volume resistance value was obtained in the above-described manner. The result is shown in Table 4. The thickness of the conducting film was 22 μm.

Example 17

A conducting film including a polymer was produced in the same way as in Example 16 except that the methoxyanilinesulfonic acid (MASA) was used instead of the dodecylbenzenesulfonic acid. Heat treatment was sequentially performed and the volume resistance value was obtained accordingly. The result is shown in Table 4. The thickness of the conducting film was 36 μm.

Example 18

A conducting film including a polymer was produced in the same way as in Example 16 except that the polystyrene sulfonic acid (PSS) was used instead of the dodecylbenzenesulfonic acid. Heat treatment was sequentially performed and the volume resistance value was obtained accordingly. The result is shown in Table 4. The thickness of the conducting film was 27 μm.

Comparative Example 2

A film of a composition including a polymer was produced in the same way as in Example 16 without using the sulfonic acid, and dried at 100° C. for 1 hour. The resultant film had a volume resistivity of $3.1\times10^{9}$ Ω·cm, and a thickness of 15 μm.

TABLE 4

| | | Volume resistivity (Ω · cm) | | |
|---|---|---|---|---|
| | Sulfonic acid | 130° C. × 1 hr | Left condition + 150° C. × 1 hr | left-conditions + 170° C. × 1 hr |
| Ex. 16 | Dodecylbenzenesulfonic acid | $9.9 \times 10^{3}$ | $1.5 \times 10^{2}$ | $1.7 \times 10^{1}$ |
| Ex. 17 | Methoxyanilinesulfonic acid | $8.7 \times 10^{2}$ | $1.1 \times 10^{2}$ | $3.3 \times 10^{-1}$ |
| Ex. 18 | Sulfonated polystyrene | $4.7 \times 10^{4}$ | $1.8 \times 10^{1}$ | $1.1 \times 10^{0}$ |

As shown in Table 4, the results confirmed that even when the polymer was added for the sake of enhancing the film formability, the inclusion of the sulfonic acid allows the conducting film to have the conductivity by heat treatment. The results also confirmed that high conductivity can be achieved by including the low molecular weight sulfonic acid, and also the polymer including the sulfonic acid group.

Example 19

A conducting film including a polymer was produced in the same way as in Example 16 except that polyvinyl alcohol "PVA 505" (trade name) manufactured by KURARAY Co., Ltd. (diluted to have a solid content of 3 mass %) was used instead of "Vylonal MD-1200" (manufactured by TOYOBO CO., LTD.). The heat treatment at 170° C. was not performed. The measurement result of the volume resistance value is shown in Table 5. The thickness of the conducting film was 39 μm.

Example 20

A conducting film including a polymer was produced in the same way as in Example 18 except that polyvinyl alcohol "PVA 505" (trade name) manufactured by KURARAY Co., Ltd. (diluted to have a solid content of 3 mass %)) was used instead of "Vylonal MD-1200" (manufactured by TOYOBO CO., LTD.). The heat treatment at 170° C. was not performed. The measurement result of the volume resistance value is shown in Table 5. The thickness of the conducting film was 23 μm.

Comparative Example 3

A film of a composition including a polymer was produced in the same way as in Example 19 except that the sulfonic acid was not used, and the film was subjected to heat treatment at 130° C. for 1 hour. The resultant film had a volume resistivity of $10^{9}$ Ω·cm or more, and a thickness of 36 μm.

TABLE 5

| | | Volume resistivity (Ω · cm) | |
|---|---|---|---|
| | Sulfonic acid | 130° C. × 1 hr | Left condition + 150° C. × 1 hr |
| Ex. 19 | Dodecylbenzenesulfonic acid | $3.6 \times 10^{-1}$ | $1.7 \times 10^{-1}$ |
| Ex. 20 | Sulfonated polystyrene | $1.9 \times 10^{-1}$ | $1.5 \times 10^{-1}$ |

As shown in Table 5, the results confirmed that even when the polyvinyl alcohol was used as a polymer, the inclusion of the sulfonic acid allows the conducting film to have the conductivity by heat treatment. The results also confirmed that high conductivity can be achieved by including the low molecular weight sulfonic acid, and also the polymer including the sulfonic acid group.

INDUSTRIAL APPLICABILITY

As described above, the conducting film of the present invention can be used in the form of, e.g., a coating material, a layered body, a film, and a sheet, and can be applied to an antistatic film and plastic, an antistatic coating, and a solid electrolyte for capacitors. The conductivity of the conducting film of the present invention is a characteristic attributed to the movability of conjugated pi electrons in the graphene. The readily movable conjugated pi electrons in the conducting film are known to be effective for transmitting heat. Therefore, the conducting film of the present invention is useful as a thermally conducting film, as well as useful for heat radiation of electronics devices, mobile devices, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A conducting film comprising:

(A) graphene oxide having an average particle diameter of 2 μm or more, and/or derivatives thereof; and (B) a compound having an aromatic sulfonic acid group (excluding a polymer having a sulfonic acid group), wherein the conducting film is subjected to a heat treatment at a temperature of more than 100° C. and 250° C. or less for a heat treatment time of from 10 minutes to 6 hours, and the conducting film has a volume resistivity of from $1\times10^{-5}$ Ω·cm or more and $1\times10^{4}$ ·cm or less, and has a thickness in a range from 0.003 mm to 0.5 mm.

2. The conducting film according to claim 1, wherein the component (B) is at least one material selected from a monomer and an oligomer having a sulfonic acid group.

3. The conducting film according to claim 1, wherein a composition ratio of the components (A) and (B) is such that a content of the component (B) is 3 parts by mass or more and 200 parts by mass or less with respect to 100 parts by mass of the component (A).

4. The conducting film according to claim 1, further comprising a polymer excluding a polymer having a sulfonic acid group as a component (C).

5. The conducting film according to claim 4, wherein the component (C) is a non-conductive polymer.

6. The conducting film according to claim 1, wherein the component (A) is graphene oxide including a multilayered body produced by oxidation decomposition of graphite.

7. A method for producing the conducting film of claim 1, comprising:

preparing a dispersion by dispersing a component comprising (A) graphene oxide having an average particle diameter of 2 μm or more, and/or derivatives thereof, and (B) a compound having a sulfonic acid group in a dispersion medium, applying the dispersion on a substrate and drying it, and performing heat treatment at a temperature of 100° C. or more, thereby obtaining a conducting film having a volume resistivity of $1\times10^4$ Ω·cm or less and a thickness in a range from 0.003 mm to 0.5 mm.

8. The method for producing a conducting film according to claim 7, wherein the heat treatment condition comprises a heat treatment temperature of more than 100° C. and 250° C. or less.

9. The method for producing a conducting film according to claim 7, wherein the heat treatment condition comprises a heat treatment time in a range from 10 minutes to 6 hours.

10. The method for producing a conducting film according to claim 7, wherein the dispersion medium is water or an organic solvent.

11. The method for producing a conducting film according to claim 7, wherein the conducting film produced is peeled off and separated from the substrate.

* * * * *